US006312079B1

(12) United States Patent
Anderson et al.

(10) Patent No.: US 6,312,079 B1
(45) Date of Patent: Nov. 6, 2001

(54) PRINT HEAD DRIVE SCHEME FOR SERIAL COMPRESSION OF I/O IN INK JETS

(75) Inventors: Frank Edward Anderson, Sadieville; Thomas Jon Eade, Lexington; George Keith Parish, Winchester, all of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/400,966

(22) Filed: Sep. 22, 1999

(51) Int. Cl.[7] ..... B41J 2/01
(52) U.S. Cl. ..... 347/12
(58) Field of Search ..... 347/9, 12, 13, 347/180, 181, 40, 42

(56) References Cited

U.S. PATENT DOCUMENTS

| | | | | |
|---|---|---|---|---|
| 5,265,315 | * | 11/1993 | Hoisington et al. | 29/25.35 |
| 5,541,629 | | 7/1996 | Saunders et al. . | |
| 5,594,478 | | 1/1997 | Matsubara et al. . | |
| 5,635,968 | | 6/1997 | Bhaskar et al. | 347/59 |
| 5,644,342 | | 7/1997 | Argyres . | |
| 5,648,806 | | 7/1997 | Steinfield et al. | 347/87 |
| 5,790,140 | | 8/1998 | Koizumi et al. . | |

FOREIGN PATENT DOCUMENTS 0 822 073 A2 7/1997 (EP) .

* cited by examiner

*Primary Examiner*—John Barlow
*Assistant Examiner*—Craig A. Hallacher
(74) *Attorney, Agent, or Firm*—Luedeka, Neely & Graham

(57) ABSTRACT

The invention relates to a method and an apparatus for firing the nozzles on an ink jet print head cartridge that requires a reduced number of data lines between the ink jet print head cartridge and the printer electronics. A group data line provides serial group select data that is stored in a set of group select latches on the ink jet print head cartridge and identifies a particular group of nozzles on the ink jet print head. A primitive data line provides primitive select data that is stored in a set of primitive select latches on the ink jet print head cartridge and identifies a particular nozzle in the selected set of nozzles. A first clock line provides a first clock signal that is used to advance the group select data and the primitive select data into the group select latches and primitive select latches respectively. The group select data and the primitive select data is decoded to produce firing data which is advanced to a set of firing latches in accordance with a second clock signal that is provided on a second clock line. The data in the firing latches is logically ANDed or NANDed with a firing pulse provided on a firing line in order to expel a drop of ink from the selected nozzle or nozzles on the ink jet print head cartridge.

25 Claims, 6 Drawing Sheets

PRINT HEAD DRIVE SCHEME FOR SERIAL COMPRESSION OF I/O IN INK JETS

FIELD OF THE INVENTION

The invention relates generally to ink jet printers. More particularly, the invention relates to a method and apparatus for addressing and firing the nozzles on an ink jet print head cartridge that minimizes the data lines necessary to address the nozzles.

BACKGROUND OF THE INVENTION

An ink jet print head cartridge has a number of nozzles on a substrate that are used to expel drops of ink onto a printing surface. As the print head cartridge scans across a printing surface, the nozzles are fired at precisely determined times to expel drops of ink and produce an image on the printing surface. In order to decrease the time required to print an image or increase the resolution of a printed image, larger and larger numbers of nozzles are being placed on modern ink jet print head cartridges. As the number of nozzles on the print head increases, the number of input data lines required to address and fire the nozzles also increases. Unfortunately as the number of input lines to the ink jet print head increases, so does the cost and complexity of manufacturing the print head. In addition, the increasing complexity of the connections between the printer electronics and the ink jet print head leads to a decrease in the manufacturing yield when producing the print head. Thus, there is a need to reduce the number of data lines between an ink jet print head cartridge and the printer electronics of an ink jet printer.

SUMMARY OF THE INVENTION

Therefore, the present invention provides a method and apparatus for firing the nozzles of an ink jet print head that requires a reduced number of data lines to address and fire a particular selected nozzle out of a given number of nozzles on the print head.

With regard to the foregoing, the present invention provides a method of firing the nozzles of an ink jet print head cartridge that includes the step of generating and supplying serial group selection data, serial primitive selection data, and a fire pulse to the print head cartridge. A group of nozzles is selected based upon the serial group selection data. Particular nozzles within the selected group of nozzles are selected based upon said serial primitive data. The selected particular nozzles are fired based in part on the firing pulse.

Preferably, the above discussed method further includes the steps of storing the serial group selection data on the ink jet print head cartridge in a first memory and storing the serial primitive selection data on the print head cartridge in a second memory. The serial group selection data and the serial primitive data are advanced into the first memory and the second memory in accordance with a first clock signal. The serial group selection data is decoded to produce selected group result data. A logical AND or a logical NAND operation is performed on the selected group result data and the serial primitive data stored in the first memory and the second memory to produce firing data. The firing data is advanced into a firing memory in accordance with a second clock signal. The selected particular nozzles are fired by performing a logical AND or a logical NAND operation on the firing data and the firing pulse to fire the selected particular nozzles.

Addressing the nozzles of an ink jet print head by providing serial group selection data that indicates a particular group of nozzles and serial primitive selection data that indicates individual nozzles to be activated within the selected group allows the nozzles to be addressed in any sequence and requires less input lines than prior art approaches. In addition, the method provides speed advantages over prior art approaches that send all of the nozzle firing data serially over a single data line. Thus, the above described method represents a substantial improvement over prior art methods of addressing the nozzles of an ink jet print head.

Another embodiment of the present invention is directed toward an apparatus for communicating firing information to a print head having a plurality of ink firing elements. The apparatus includes data processing means for producing group selection data, primitive selection data, and a fire pulse. A group data line serially supplies the group selection data to the print head and a primitive data line serially supplies the primitive selection data to the print head. A fire pulse line supplies a fire pulse to the print head. Group selecting means on the print head select a group of firing elements from the plurality of firing elements based upon the serial group selection data. Primitive selecting means on the print head select particular firing elements within the group of firing elements based upon the primitive selection data. Firing means fire the particular firing elements based in part on the firing pulse.

The present invention further comprehends an embodiment wherein the apparatus has a set of group selection latches on the print head for storing the serial group selection data. A set of primitive latches on the print head store the primitive selection data. A first clock line supplies a first clock signal that is used to advance the serial group selection data into the set of group selection latches and the primitive selection data into the set of primitive latches. In this embodiment, the group selection data is a group address and the group selecting means comprise a decoder for receiving the group address from the group selection latches and decoding the group address to produce a selected group signal that contains a logical selection state for each group of firing elements. Firing element selection logic means perform a logical AND or a logical NAND operation on the selected group signal and the primitive selection data to produce firing data that contains a logical selection state for each firing element. A second clock line supplies a second clock signal that is used to advance the firing data to a set of firing latches that store the firing data. There is one firing latch that corresponds to each firing element. Firing logic means perform a logical AND or a logical NAND operation on the stored firing data and the firing pulse to fire the selected firing elements.

In an alternative embodiment the group selection data contains a logical selection state for each group of firing elements and the group selecting means comprise group bus lines for addressing the selected group. In addition, the primitive selecting means comprise primitive bus lines for addressing the selected firing elements within the selected group. Logic means perform a logical ANDing of the group selection data and the primitive selection data to determine the particular firing elements to be activated.

The present invention also comprehends an embodiment having a first and a second primitive data line. In such an embodiment, the primitive selection data includes first primitive selection data and second primitive selection data. The first primitive data line supplies the first primitive selection data to the print head and the second primitive data line supplies the second primitive selection data to the print head. The provision of two primitive data lines allows a greater number of primitive data bits to be supplied to the ink jet print head in a reduced amount of time.

The present invention further envisions a method of individually addressing and firing nozzles on an ink jet print head with a reduced number of data lines wherein the nozzles are arranged into a plurality of groups each having a plurality of nozzles and wherein the nozzles can be addressed and fired in any order. The method includes the step of serially providing group select data containing the address of a selected group of nozzles to the ink jet print head on a group data line. In addition, primitive select data containing a logical selection state for each of the plurality of nozzles in the selected group of nozzles is serially provided to the ink jet print head on a primitive data line. The group select data is decoded to determine a logical selection state for each group of nozzles. One of a logical ANDing or a logical NANDing operation of the logical selection state for each group of nozzles with the logical selection state for each of the plurality of nozzles is performed to produce a firing result. A fire pulse is provided and one of a logical ANDing or a logical NANDing operation of the firing result with the fire pulse is performed to fire nozzles of the ink jet print head selected by the serial group select data and the serial individual primitive select data.

In a preferred embodiment of the above discussed method the serial group select data, the serial primitive select data, and the firing result are temporarily stored on the ink jet print head. The serial group select data and the serial primitive select data are stored in accordance with a first clock signal. The firing result is stored in accordance with a second clock signal.

The above discussed methods and apparatus for addressing and firing the nozzles of an ink jet print head allow a greater number of nozzles to be addressed and fired with a reduced number of data lines running between the print head cartridge and the printer electronics. Reducing the number of data lines decreases the complexity and the production cost of the ink jet print head. Since most ink jet print head cartridges are designed to be disposable, a method and apparatus which reduces their cost represents a substantial improvement over the prior art.

BRIEF DESCRIPTION OF THE DRAWINGS

Further advantages of the invention will become apparent by reference to the detailed description when considered in conjunction with the figures, wherein like reference numbers indicate like elements through the several views, and wherein.

DETAILED DESCRIPTION OF THE INVENTION

Figure 1:
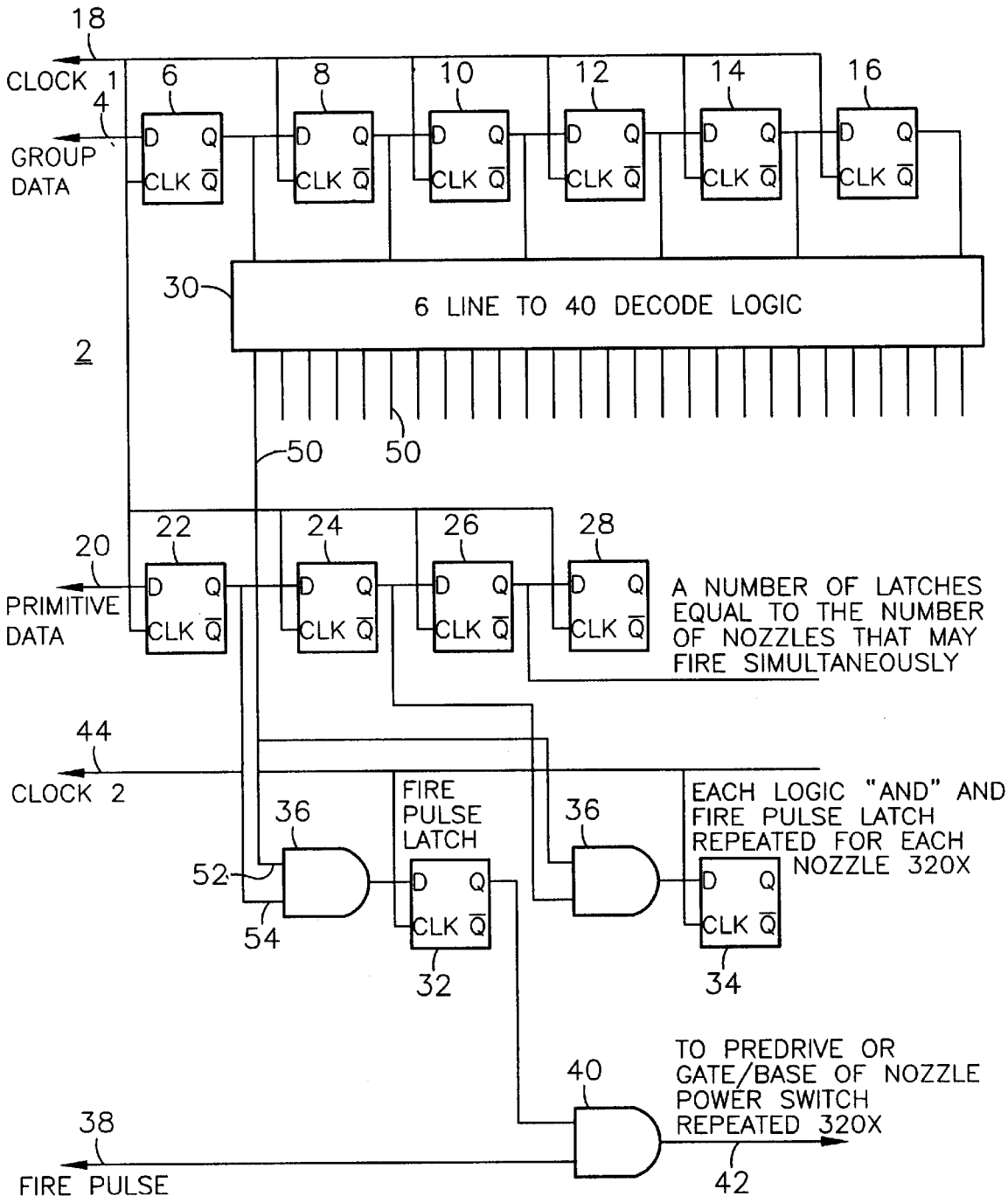
FIG. 1 is a schematic drawing of an embodiment of the present invention.

With reference to FIG. 1, there is shown, in schematic form, a receiving circuit 2 which is disposed on an ink jet printhead cartridge. A group data line 4 is used to receive serial group select data from printer electronics which are preferably disposed on a printer separate from the print head cartridge. The serial group select data line contains the address of a particular group of nozzles on the ink jet print head. In the preferred embodiment, the ink jet print head contains 320 nozzles that are arranged into forty groups of eight nozzles each. Thus, in the preferred embodiment, the serial group selection data contains the address of one of the forty groups of nozzles. However, it is readily appreciated that the present invention can be applied to a print head having any number of nozzles arranged in groups of any size.

In order to address the forty groups of eight nozzles, a six bit binary address is serially placed on the group data line 4. The group data line 4 is electrically connected to a set of group select latches 6, 8, 10, 12, 14 and 16 that are arranged in series. As the serial group select data is received on the group data line 4, it is advanced into the group select latches 6, 8, 10, 12, 14 and 16 in accordance with a first clock signal received on a first clock line 18. When the first bit of the six bits of serial group select data is placed on the group data line 4, the first clock signal on the first clock line 18 is used to advance the first bit into group select latch 6. During the next clock pulse on clock line 18, the first bit is advanced from group select latch 6 to group select latch 8 and the second bit of the serial group select data is loaded from the group data line 4 into group select latch 6. The process is repeated until all six bits of the serial group select data have been loaded into the group select latches 6, 8, 10, 12, 14 and 16.

The group select data stored on the group select latches 6, 8, 10, 12, 14 and 16 provides the input to a six line-to-forty line decoder 30. The six line-to-forty line decoder 30 processes the six group select data bits to determine which one of the forty groups of nozzles is being accessed. An active signal is then placed on the output line of the forty line decoder 30 that corresponds to the selected group of nozzles. The active signal can be a logic one or a logic zero depending upon the particular logic scheme chosen to address the nozzles of the ink jet printhead cartridge.

Serial primitive select data is provided to the ink jet print head on a primitive data line 20 simultaneously with the serial group select data. In the preferred embodiment, one bit of primitive select data is used to represent each nozzle in a group of nozzles. For example, the primitive select data "10001000" would indicate that the first and fifth nozzle in the selected group of nozzles are to be fired. Thus, the provision of one primitive select data bit for each nozzle in a group allows all of the nozzles in the group to be simultaneously fired if desired. However, it is readily appreciated that the primitive select data may also be the address of a particular nozzle within the selected group of nozzles that is decoded in a manner similar to the group select data to select and fire only the selected nozzle.

Referring back to FIG. 1, the serial primitive select data received on primitive data line 20 is advanced into a set of primitive select latches 22, 24, 26, and 28 in accordance with the first clock signal provided by the first clock line 18. Since the preferred embodiment has the nozzles divided up into groups of eight, the preferred embodiment has eight primitive select latches, one for each bit of serial primitive select data. However, in the interest of simplicity, only four primitive latches 22, 24, 26 and 28 are shown in FIG. 1, but they schematically represent all eight latches.

The primitive select data stored on each of the primitive select latches 22, 24, 26 and 28 is logically ANDed with an AND gate, or NANDed with a NAND gate depending upon the particular logic scheme being used, with each of the outputs of the six line-to-forty line decoder 30 to produce a firing signal. The firing signal is advanced to a set of firing latches 32 and 34 in accordance with a second clock signal provided on a second clock line 44. In a preferred embodiment, every nozzle has an associated firing latch 32 and an associated AND gate 36. However, in the interest of simplicity, only two of the firing latch 32 and AND gate 36 combinations are shown in FIG. 1, but they schematically represent all 320 firing latches. Furthermore, it is understood that the fire latches could be placed before the group and primitive logic circuits such that the 320 nozzle configuration with 40 address groups and 8 primitive data requires only 48 firing latches (not one for each nozzle). In such an embodiment, the address, primitive, and fire signal logic are after the firing latch and enable the specific nozzles to fire. Returning to the above described process, every firing latch 32 and 34 that corresponds with a nozzle that is to be fired is provided with an active firing signal. As previously discussed, the active firing signal could be a logical one or a logical zero depending upon the particular logic scheme adopted. The outputs of the firing latches 32 and 34 are then logically ANDed through AND gates 40 with a fire pulse signal provided on a fire pulse line 38 to fire the selected nozzles and expel a drop of ink. While the above discussed embodiment utilizes an AND gate structure, it will be readily appreciated by one of ordinary skill in the art that a similar function can also be accomplished with a NAND gate structure.

The firing pulse on the fire pulse line 38 is used to fire the nozzles instead of the logical firing signal so that the actual pulse used to fire the nozzles can be tightly controlled in order to deliver the optimum energy to the nozzle and thereby assure the best print quality. However, if a particular application demanded it, the present invention comprehends that the logical firing signal itself could be used to fire the selected nozzles.

The embodiment of FIG. 1 allows 320 nozzles to be addressed with only five input data lines. The reduced number of input data lines results in a print head cartridge of decreased complexity that is less expensive to manufacture. In addition, the provision of a group data line and a primitive data line allows data addressing a particular group of nozzles and data addressing individual nozzles within that group to be simultaneously received by the ink jet print head cartridge. If all the data needed to address the nozzles is serially transmitted to the ink jet print head cartridge on one line, the time required to receive the data becomes prohibitively long and the printing operation must be slowed down. Conversely, if every data bit has its own data line so that every bit of data may be transmitted simultaneously, an excessive number of data lines are required and the complexity and expense of the ink jet print head cartridge become prohibitively high. Thus, the above discussed embodiment provides an advantageous compromise between the competing goals of reducing the amount of time necessary to address the nozzles and reducing the number of lines necessary to address the nozzles and is a substantial improvement upon the prior art.

Figure 2:
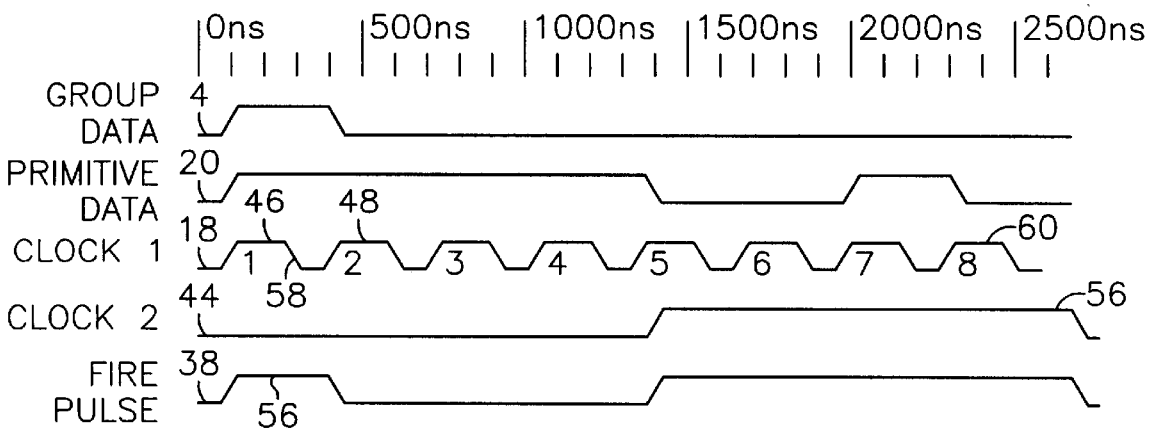
FIG. 2 is a timing diagram for an embodiment of the present invention.

FIG. 2 is a timing diagram for a preferred embodiment of the present invention. When the first clock signal 46 is first provided to the group select latches 6, 8, 10, 12, 14 and 16 and the primitive select latches 22, 24, 26 and 28 on the clock line 18, the first bit of group select data is stored in group select latch 6 and the first bit of primitive select data is stored in primitive select latch 22. In the preferred embodiment, the data is loaded on the falling edge 58 of the clock signal 46. Thus, as shown in FIG. 2, the first bit of data on the group data line 4 is a logical one and the first bit of data on the primitive data line 20 is also logical one. However, it is understood that the rising edge of the clock signal, as well as a variety of other timing schemes, may be used to trigger the loading of the data in accordance with the present invention. When the next clock signal 48 on the first clock line 18 is received by the latches, the first bit of group select data is moved from the first group select latch 6 to the second group select latch 8 and the second bit of group select data is loaded into the first group select latch 6. Similarly, the first bit of primitive select data is moved from the first primitive select latch 22 to the second primitive select latch 24 and the second bit of primitive select data is loaded into the first primitive select latch 22. As shown in FIG. 2, the second bit of group select data is a logical zero and the second bit of primitive select data is a logical one. The shifting process is repeated until all of the serial group select data and serial primitive select data is loaded into the respective group select latches and primitive select latches. In an embodiment where both the serial group select data and the serial primitive select data consists of eight bits of data, the loading process will be completed with clock signal 60. In embodiments where the primitive select data contains more bits that the group select data, a number of additional unused bits equal to the number of additional primitive data bits will be loaded in the group select latches 6, 8, 10, 12, 14, and 16 before the actual group select data is loaded into the latches. This will prevent the group select data from being shifted past the last group select latch 16 before all of the primitive data has been stored in the primitive select latches 22, 24, 26 and 28.

The group select data contained on the group select latches 6, 8, 10, 12, 14 and 16 is provided to a decoder 30 that produces an output on its output lines 50 that is indicative of the selected group of nozzles. The respective output lines 50 of the decoder 30 are provided to the inputs of a series of AND gates 36. The primitive select data stored on the primitive select latches 22, 24, 26 and 28 is provided to the other inputs of the series of AND gates. After the last bit of serial primitive and group select data has been clocked into the latches and decoded, a second clock signal 56 on a second clock line 44 is used to advance the outputs of the series of AND gates 36 into the firing latches 32 and 34 corresponding to the nozzles of the ink jet print head. Thus, an active state will be saved on the respective firing latch 32 or 34 of a nozzle only if the group select data input 52 and the primitive select data input 54 of the AND gate 36 associated with the nozzle arc active. The output of the firing latch 32 determines whether or not the corresponding nozzle associated with the firing latch 32 will be activated to expel ink. As previously discussed, it is understood that an active state for the firing latch 32 could be a logical one or a logical zero depending upon the particular logic scheme used. It is further understood that NAND gates could be used instead of the AND gates 36 to accomplish the same result simply by inverting the output.

The outputs of the respective firing latches 32 and 34 are provided to the inputs of a series of associated AND gates 40. The other input of the associated AND gates 40 is connected to a firing pulse line 38 that provides a firing pulse 56. Thus, if the respective firing latch 32 or 34 of a nozzle contains an active state when a firing pulse 56 is transmitted on firing pulse line 38, the output of the respective AND gate 40 will go active. The output of the AND gate 40 is provided to the firing element of the associated nozzle. Therefore, an active state at the output of the AND gate will cause the associated nozzle to expel a drop of ink.

Figure 3:
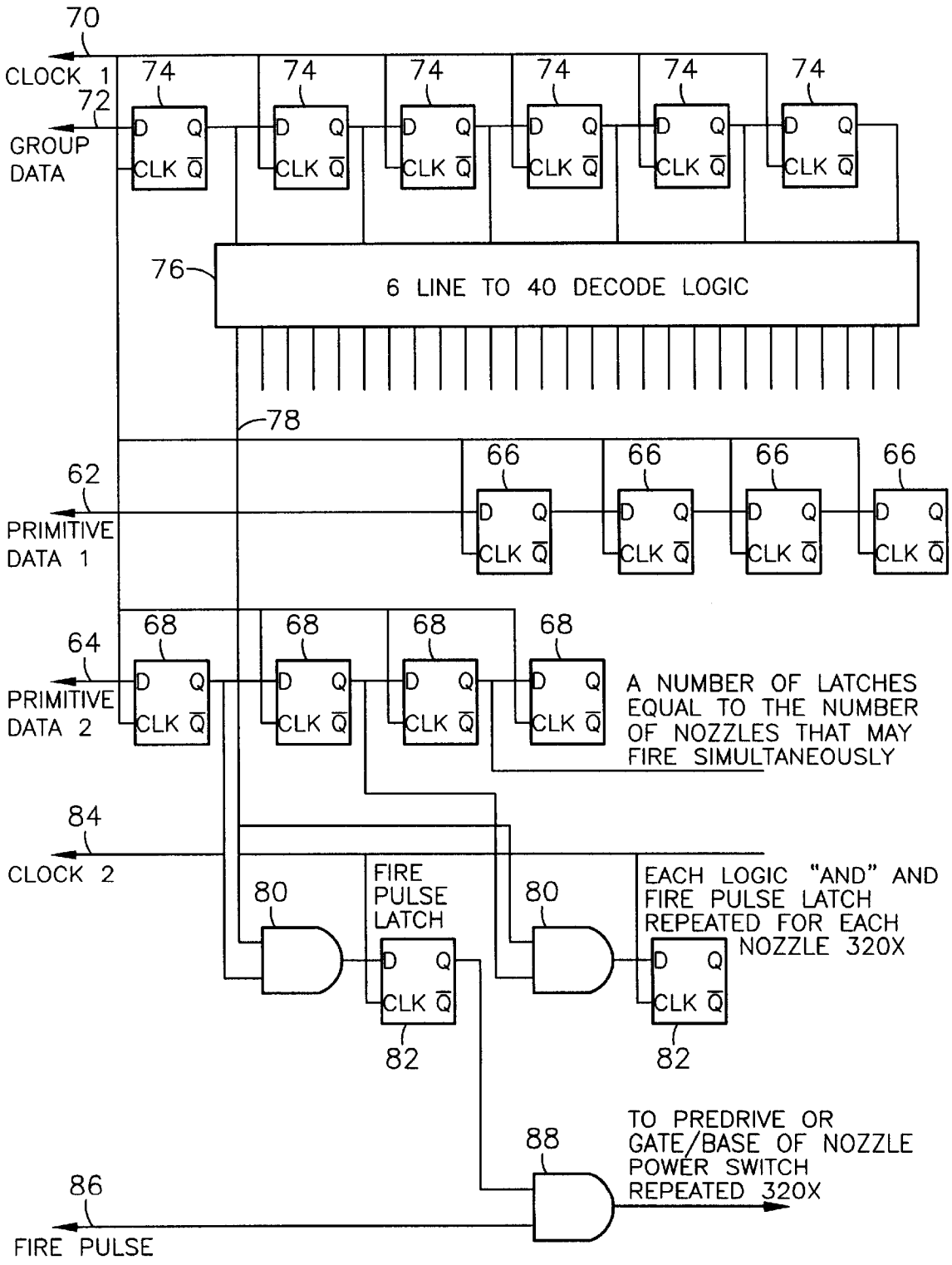
FIG. 3 is a schematic drawing of an embodiment of the present invention having an additional primitive data line for increasing the allowable number of nozzles without increasing the required clock frequency.

Referring to FIG. 3, a second embodiment of the present invention is shown. The embodiment shown has two primitive data lines 62 and 64. Primitive data line 62 has a first series of associated primitive data latches 66 into which data is advanced in accordance with a first clock signal provided on a first clock line 70. Primitive data line 64 has a second series of associated primitive data latches 68 into which data is advanced in accordance with the first clock signal on the first clock line 70. In FIG. 3, primitive data lines 62 and 64 are each shown as having four associated latches 66 and 68. However, it is appreciated that in practice the actual number of associated latches 66 and 68 will depend upon the number of nozzles on the ink jet print head and the particular configuration of the present invention selected. In the preferred embodiment, the total number of primitive select latches 66 and 68 is equal to the number of nozzles that can be fired simultaneously.

Group select data is received on group data line 72 and clocked into the group select latches 74 in accordance with the clock signal on the first clock line 70 in a manner similar to that discussed above with respect to the embodiment of FIG. 1. While six group select latches 74 are shown in FIG. 3, it is appreciated that the number of group select latches 74 depends upon the number of nozzles on the ink jet print head and the number of groups into which the nozzles are divided. In the preferred embodiment, the nozzles on the ink jet print head are divided up into groups wherein each group contains a number of nozzles equal to the number of nozzles that can be simultaneously fired. The number of group select latches 74 is selected according to the number of bits required to address a particular group of nozzles. Thus, if 320 nozzles are on the ink jet print head and eight nozzles can be simultaneously activated, forty groups of nozzles must be addressed. Therefore, six bits of digital data are required to address the forty groups and six group select latches 74 are required by such an embodiment. The group select data stored on the latches 74 is provided to a decoder 76 to produce an active signal on one of the outputs 78 of the decoder 76. The output lines of the decoder 76 are fed to a series of AND gates 80 wherein one AND gate 80 is associated with each nozzle on the ink jet print head. The other input of the AND gates 80 is provided by a primitive latch from one of the series of latches 66 and 68. The output of the AND gates 40 is a firing result that is loaded into a series of firing latches 82 in accordance with a second clock signal on a second clock line 84. While only two firing latches 82 are shown in FIG. 3, it is understood that they schematically represent a firing latch 82 for every nozzle on the print head. The firing result is logically ANDed through AND gate 88 with a firing pulse that is provided on a fire pulse line 86 to produce a signal that is used to fire the firing element in the nozzle associated with the particular firing latch 82 and AND gates 80 and 88.

The group select data and the primitive select data are loaded in their respective latches in accordance with the first clock signal on the first clock line 70. Thus, the time required to address a nozzle depends in part upon the number of group select and primitive select data bits needed to address the nozzle and the frequency of the first clock signal on the first clock line 70. For example, if the number of nozzles on an ink jet print head is 128, and eight of the nozzles can be fired simultaneously, four group data bits and 8 primitive data bits are required to address the nozzles in any particular group. If only one primitive data line 20 and one group data line 4 are used as shown in FIG. 1, four clock pulses are required to load the group select data and the first four bits of primitive select data, and four additional clock pulses are required to load the final four bits of primitive select data. Thus, a total of eight clock pulses are needed to load the addressing data. As an ink jet print head moves across a page that is being printed upon, a certain number of nozzles must be able to be fired in the time it takes the print head to move a given distance. Thus, the speed of the ink jet print head must be set so that all of the needed address data can be loaded and acted upon before the ink jet print head passes the desired printing location. Because a quick printing operation is desirable, it is necessary to address the nozzles as quickly as possible. The problem is further complicated by the fact that modern ink jet printers print higher resolution images by increasing the overall number of nozzles on the print head. Thus an increasing number of bits are needed to address the increasing number of nozzles.

The provision of a second primitive data line 64 allows a greater number of ink jet nozzles to be addressed in a shorter amount of time by the embodiment shown in FIG. 3. Using the example discussed above, assume that four group select data bits are required and eight primitive select data bits are required to address the nozzles of an ink jet print head. If there is only one primitive data line, four clock pulses will be needed to load the four group select data bits and the first four primitive data select bits, and an additional four clock pulses will be needed to load the remaining four primitive select data bits. Thus, a total of eight clock pulses on the first clock line 70 will be needed to load the four group select data bits and eight primitive select data bits. However, if two primitive data lines are used only four clock pulses will be required to load the eight primitive select data bits and the four group select data bits. Thus, the provision of an additional primitive data line as shown in FIG. 3 increases the speed with which the nozzles of an ink jet print head can be addressed. Furthermore, the present invention comprehends that the actual number of primitive data lines utilized will depend upon the particular application in the field and that in some circumstances the provision of an additional group select data line may also be necessary.

Figure 4:
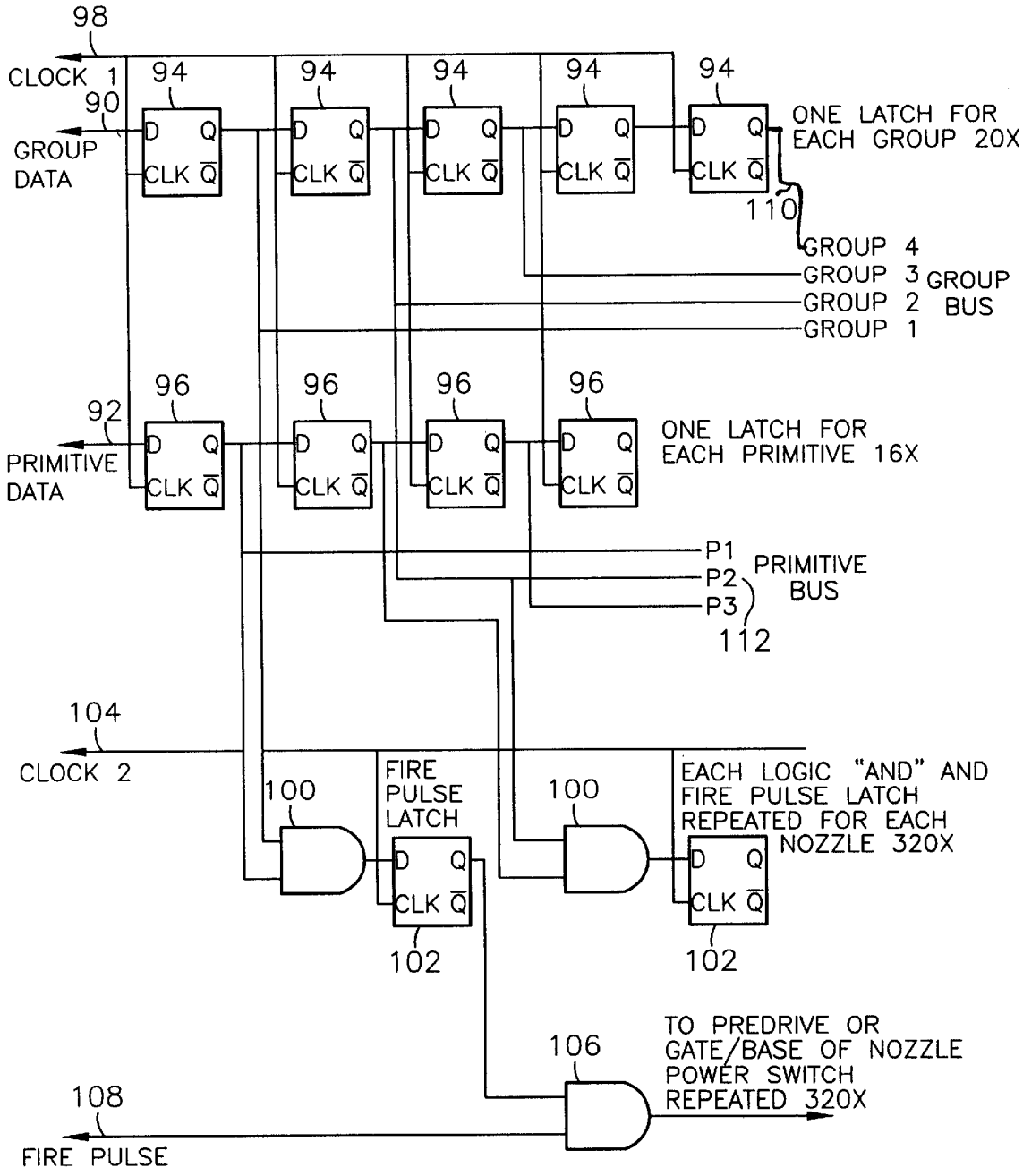
FIG. 4 is a schematic diagram of an embodiment of the present invention that substitutes bus lines for a decoder.

Turning now to FIG. 4, an alternative embodiment is shown wherein no decoder as shown in FIGS. 1 and 3 is needed. In accordance with the embodiment, a group data line 90 and a primitive data line 92 are provided. A number of group select latches 94 are provided wherein the number of group select latches 94 is equal to the number of groups of nozzles. The number of nozzles in each group is equal to the number of nozzles on the ink jet print head that can be fired simultaneously. The number of primitive select latches 96 is also equal to the number of nozzles that can be fired simultaneously. The serial primitive select data and the serial group select data is advanced into the primitive select latches 96 and the group select latches 94 in accordance with a clock signal on a first clock line 98. Once the group select data is stored in the group select latches 94, the output of each group latch 94 is provided to a series of AND gates 100 associated with the particular group latch 94 by way of a group bus 110. One AND gate 100 is associated with every nozzle in the group of nozzles. Not all of the group bus lines 110 and AND gates 100 have been shown in FIG. 4 for the sake of simplicity and clarity. However, they are schematically represented by group bus lines 110 and AND gates 100. The primitive select data stored on each of the primitive select latches 96 is provided to a series of associated AND gates 100 through a primitive bus 112. The AND gates 100 associated with each primitive select latch 96 correspond to one nozzle from each group of nozzles.

The output of the AND gates 100 is supplied to a series of firing latches 102 in accordance with a second clock signal on a second clock line 104. Each firing latch 102 corresponds to a particular nozzle on the ink jet print head. Thus, the actual number of firing latches 102 is equal to the number of nozzles on the print head cartridge. These firing latches are schematically represented by firing latches 102. The outputs of the firing latches 102 are supplied to a series of AND gates 106 that logically AND the outputs with a firing pulse provided on a fire pulse line 108. The output of the AND gates 106 is then used to trigger the firing of the selected nozzles. Thus, the embodiment of FIG. 4 uses bus wiring and an increased number of group select latches to dispense with the need for a decoder to decode the group select data.

Figure 5:
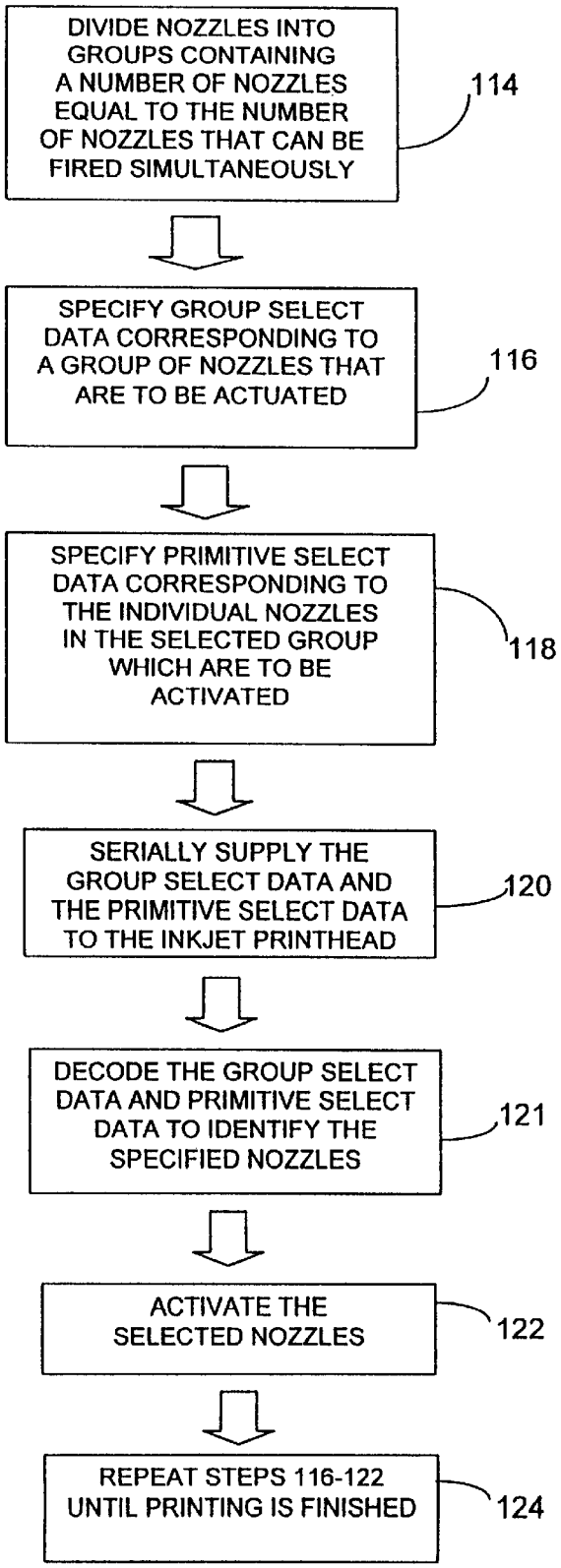
FIG. 5 is a flow chart of a method of firing the nozzles of an ink jet print head in accordance with the present invention.

Referring now to FIG. 5, a method of addressing the nozzles of an ink jet print head in accordance with the present invention is shown. The method begins with step 114 wherein the nozzles on the ink jet print head are divided into groups that contain a number of nozzles equal to the number of nozzles that can be fired simultaneously. In further accordance with the method, group select data that corresponds to a group of nozzles that are to be activated is specified as shown in block 116. As previously discussed, the group select data can be the address of a group of nozzles or a bit map corresponding to a selected group or groups of nozzles. In block 118, primitive select data corresponding to the individual nozzles in the selected group or groups of nozzles is also specified. Once the group select and primitive select data have been specified, the method proceeds to block 120 and the group select data and the primitive select data are serially supplied to the ink jet print head. In block 121, the group select data and the primitive select data are decoded to determine the nozzles on the ink jet print head that are to be activated. The nozzles indicated by the group select data and the primitive select data are then activated to expel drops of ink in step 122. In step 124, steps 114–122 are repeated until the print operation is complete.

Specifying the nozzles to be activated with group select data and primitive select data that is serially supplied to the ink jet print head allows a significantly reduced number of interconnect lines to be employed between the ink jet printer and the print head cartridge. Significantly reducing the number of data lines between the printer and the print head results in reduced costs. In addition, the reduction in wiring also makes possible improved wireability that allows an ink jet printer to print closer to the margins of a page. One approach to reducing the number of data lines is to use serial ring counters to sequentially progress through the nozzle addresses so that only firing signals need to be sent at the appropriate time. However, serial ring counters cannot use any address other than the next address in their sequence. The preferred embodiment of this invention is able to sequence the address for the next fire pulse to any available address. Thus, the present invention can take advantage of the ability to skip addresses to increase the print head carrier speed.

Figure 6:
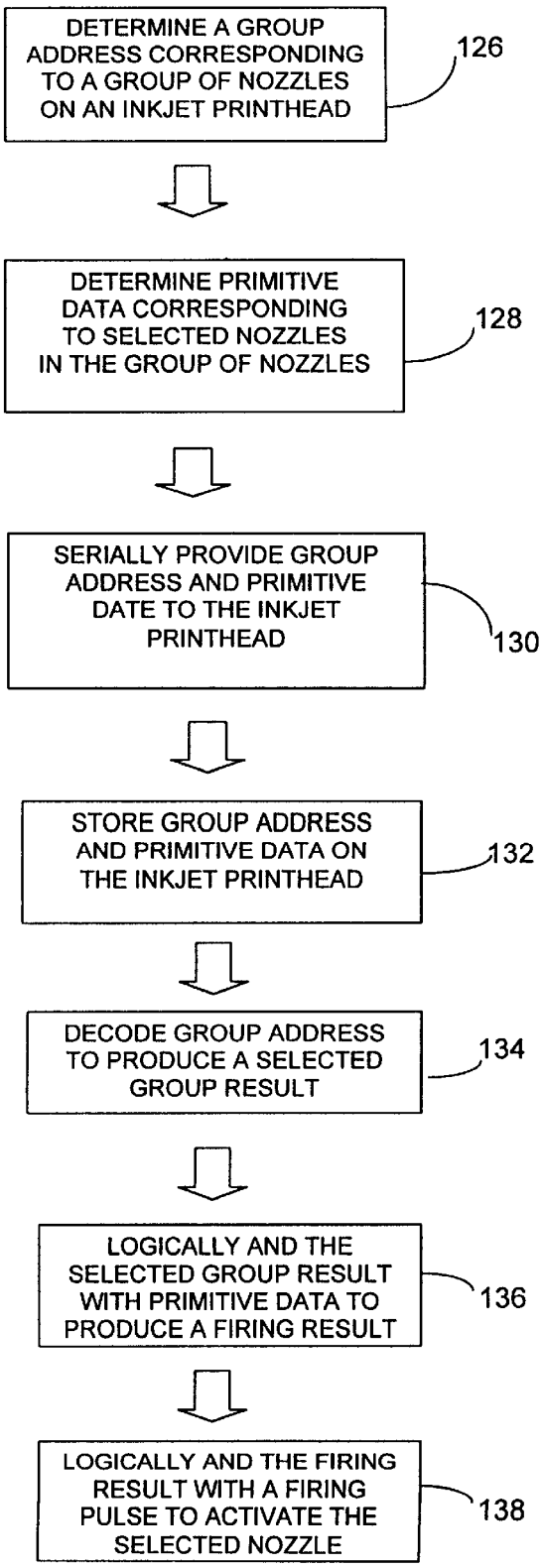
FIG. 6 is a flow chart of a second method of firing the nozzles of an ink jet print head in accordance with the present invention.

Another method of addressing the nozzles on an ink jet print head in accordance with the present invention is shown in FIG. 6. This method begins in block 126 with the step of determining a group address corresponding to a group of nozzles on an ink jet print head. In block 128, primitive data corresponding to the selected nozzles in the group of nozzles that are to be activated is determined. The group address and the primitive data are serially provided to and stored on the ink jet print head cartridge in steps 130 and 132. The method then proceeds to step 134 wherein the group address is decoded to produce a selected group result. In block 136, the selected group result is logically ANDed with the primitive data to produce a firing result. Finally, in step 138, the firing result is logically ANDed with a firing pulse decoded to activate the selected nozzles.

The above discussed method for activating the nozzles of an ink jet print head cartridge requires less data lines between the printer electronics and the print head cartridge than a typical method used in an ink jet printer. Furthermore, the use of inexpensive logic gates to decode the group address results in a lower cost print head cartridge. Therefore, the above discussed method is a substantial improvement over the prior art methods.

Having described various aspects and embodiments of the invention, and several advantages thereof, it will be recognized by those of ordinary skills that the invention is susceptible to various modifications, substitutions and revisions within the spirit and scope of the appended claims.

What is claimed is:

1. A method of firing the nozzles of an ink jet print head cartridge, said method comprising the steps of:

generating and supplying serial group selection data on a single group selection line, serial primitive selection data on a single primitive select line, and a fire pulse to the print head cartridge;

selecting a group of nozzles based upon said serial group selection data;

selecting particular nozzles within said selected group of nozzles based upon said serial primitive data; and firing the selected particular nozzles based in part on said firing pulse.

2. The method of claim 1 further comprising the step of storing said serial group selection data on said ink jet print head cartridge in a first memory.

3. The method of claim 2 further comprising the step of storing said serial primitive selection data on said print head cartridge in a second memory.

4. The method of claim 3 wherein said serial group selection data and said serial primitive data are advanced into said first memory and said second memory in accordance with a first clock signal.

5. The method of claim 4 further comprising the steps of decoding said serial group selection data to produce selected group result data and performing a logical AND or a logical NAND operation on said selected group result data and said serial primitive data stored in said first memory and said second memory to produce firing data.

6. The method of claim 5 further comprising storing said firing data in a firing memory.

7. The method of claim 6 further comprising advancing said firing data into said firing memory in accordance with a second clock signal.

8. The method of claim 7 wherein the step of firing said selected particular nozzles further comprises the step of performing a logical AND or a logical NAND operation on said firing data and said firing pulse to fire said selected particular nozzles.

9. An apparatus for communicating firing information to a print head having a plurality of ink firing elements, said apparatus comprising:

data processing means for producing group selection data, primitive selection data, and a fire pulse;

a single group data line for serially supplying said group selection data to said print head;

a single primitive data line for serially supplying said primitive selection data to said print head;

a fire pulse line for supplying a fire pulse to said print head;

group selecting means on said print head for selecting a group of firing elements from the plurality of firing elements based upon said serial group selection data;

primitive selecting means on said print head for selecting particular firing elements within said group of firing elements based upon said primitive selection data;

firing means for firing the particular firing elements based in part on said firing pulse.

10. The apparatus of claim 9 further comprising a set of group selection latches on said print head for storing said serial group selection data.

11. The apparatus of claim 10 further comprising a set of primitive latches on said print head for storing said primitive selection data.

12. The apparatus of claim 11 further comprising a first clock line for supplying a first clock signal that is used to advance said serial group selection data into said set of group selection latches and said primitive selection data into said set of primitive latches.

13. The apparatus of claim 11 wherein said group selection data is a group address and said group selecting means comprise a decoder for receiving said group address from said group selection latches and decoding said group address to produce a selected group signal that contains a logical selection state for each group of firing elements.

14. The apparatus of claim 13 further comprising firing element selection logic means for performing a logical AND or a logical NAND operation on said selected group signal and said primitive selection data to produce firing data that contains a logical selection state for each firing element.

15. The apparatus of claim 14 further comprising a second clock line for supplying a second clock signal that is used to advance said firing data to a set of firing latches for storing said firing data wherein one firing latch corresponds to each firing element.

16. The apparatus of claim 15 further comprising firing logic means for performing a logical AND or a logical NAND operation on said stored firing data and said firing pulse to fire the selected firing elements.

17. The apparatus of claim 13 further comprising firing logic means for performing a logical AND or a logical NAND operation on said selected group signal and said primitive data with said firing pulse to produce group and primitive firing data.

18. The apparatus of claim 17 further comprising a second clock line for supplying a second clock signal that is used to advance said group and primitive firing data to a set of firing latches for storing said group and primitive firing data.

19. The apparatus of claim 18 further comprising firing element selection logic means for performing a logical AND or a logical NAND operation on said group firing data and said primitive firing data to produce firing data that is used to fire the selected firing elements.

20. The apparatus of claim 9 wherein said group selection data contains a logical selection state for each group of firing elements and said group selecting means comprise group bus lines for addressing the selected group and the primitive selecting means comprise primitive bus lines for addressing the selected firing elements within the selected group.

21. The apparatus of claim 20 further comprising logic means for performing a logical ANDing of the group selection data and the primitive selection data to determine the particular firing elements to be activated.

22. The apparatus of claim 9 further comprising a second primitive data line wherein said primitive selection data comprises first primitive selection data and second primitive selection data and said primitive data line supplies said first primitive selection data to said print head and said second primitive data line supplies said second primitive selection data to said print head.

23. A method of individually addressing and firing nozzles on an ink jet print head with a reduced number of data lines wherein the nozzles are arranged into a plurality of groups each having a plurality of nozzles and wherein the nozzles can be addressed and fired in any order, the steps of the method comprising:

serially providing group select data containing the address of a selected group of nozzles to the ink jet print head on a group data line;

serially providing primitive select data containing a logical selection state for each of the plurality of nozzles in the selected group of nozzles to the ink jet print head on a primitive data line;

decoding the group select data to determine a logical selection state for each group of nozzles;

performing one of a logical ANDing or a logical NANDing operation of the logical selection state for each group of nozzles with the logical selection state for each of the plurality of nozzles to produce a firing result;

providing a fire pulse;

performing one of a logical ANDing or a logical NANDing operation of the firing result with the fire pulse to fire nozzles of the ink jet print head selected by said serial group select data and said serial individual primitive select data.

24. The method of claim 23 further comprising the steps of:

temporarily storing said serial group select data on said ink jet print head;

temporarily storing said serial primitive select data on said ink jet print head; and temporarily storing said firing result on said ink jet print head.

25. The method of claim 24 wherein said serial group select data and said primitive select data arc stored in accordance with a first clock signal and said firing result is stored in accordance with a second clock signal.

* * * * *